United States Patent [19]

VanCucha

[11] Patent Number: 4,946,064

[45] Date of Patent: Aug. 7, 1990

[54] SEALED CONTAINER

[75] Inventor: James M. VanCucha, Strongsville, Ohio

[73] Assignee: Cleveland Container Corporation, Cleveland, Ohio

[21] Appl. No.: 407,342

[22] Filed: Oct. 10, 1989

Related U.S. Application Data

[63] Continuation of Ser. No. 185,126, Apr. 22, 1988, Pat. No. 4,887,736.

[51] Int. Cl.[5] ..... B65D 39/00

[52] U.S. Cl. ..... 220/355; 220/308

[58] Field of Search ..... 220/355, 308, 306

[56] References Cited

U.S. PATENT DOCUMENTS

| | | | |
|---|---|---|---|
| 12,551 | 11/1906 | Maranville . | |
| 3,270,910 | 6/1963 | Lusk | 220/55 |
| 3,516,571 | 6/1970 | Roper et al. | 220/308 |
| 3,664,544 | 5/1972 | Hammes | 220/60 R |
| 3,696,962 | 10/1972 | Fehres et al. | 220/60 R |
| 3,753,512 | 8/1973 | Curry | 220/43 R |
| 3,773,208 | 11/1973 | Curry | 220/43 R |
| 3,792,797 | 2/1974 | Mrusek et al. | 220/60 R |
| 3,942,679 | 3/1976 | Starr | 220/355 |
| 3,999,677 | 12/1976 | Oberkircher | 220/266 |
| 4,078,696 | 3/1978 | Crisci | 220/308 |
| 4,166,548 | 9/1979 | Crisci | 220/308 |
| 4,220,254 | 9/1980 | Morton | 220/354 |
| 4,466,553 | 8/1984 | Zenger | 220/306 X |
| 4,674,650 | 6/1987 | Hamilton et al. | 220/319 |
| 4,887,736 | 12/1989 | Van Cucha | 220/355 |

OTHER PUBLICATIONS

The Benefits of Plastic Caps are Obvious, the 50% Savings in Gasketing Costs Are Not–W. R. Grace & Co.

The Foam Melt System–Expanding the World of Adhesives and Sealants–Nordson–1985.

*Primary Examiner*—Steven M. Pollard

*Attorney, Agent, or Firm*—Calfee, Halter & Griswold

[57] ABSTRACT

A container assembly as a lid for closing and sealing the open end of the container. The container includes an outwardly curled sealing lip at its upper most periphery. The lid includes a rim having inner and out legs, and a bridge or web connecting the legs. The legs and the bridge define a downwardly opening channel proportioned to fit over the lip of the container. The legs, bridge and the lip cooperatively define therebetween a sealant cavity or the cavity may be formed only in the bridge. The sealant cavity includes a sealing material received therein. The lid further includes contact surface means. The contact surface means selectively contact the container lip to limit the minimum size of the cavity when the lid is pressed onto the container. By limiting the minimum size of the cavity, over compression of the sealing material is avoided during application of an excessive load on the container lid.

2 Claims, 4 Drawing Sheets

SEALED CONTAINER

This is a continuation of copending application Ser. No. 07/185,126 filed on 4/22/88, now Pat. No. 4,887,736.

FIELD OF THE INVENTION

This invention relates to a container and lid assembly. More particularly, this invention relates to a container or pail having an open end sealed with a lid adapted to limit the travel of the lid relative to the container under load to avoid over compressing the seal.

BACKGROUND OF THE INVENTION

The prior art provides various containers having open ends which are closed and sealed with a lid. Many of these prior art lids include a sealing material positioned between the top peripheral rim or lip of the container and the lid. Additionally, many of these prior art lids include one or more legs or arms that serve as hooks which resiliently secure the lid to the container. An example of such a prior art container may be found in Fehres et al U.S. Pat. No. 3,696,962. The prior art also provides sealing material or gaskets for containers having continuous or solid cross sections as shown in Fehres et al., and sealing material having hollow cross sections as shown in U.S. Pat. No. 3,999,677. Additionally, the prior art provides sealing material having metal cores as shown in Starr U.S. Pat. No. 3,942,679.

SUMMARY OF THE INVENTION

The present invention provides a container or pail assembly which displays a distinct advantage over prior art container assemblies. Specifically, the present invention provides a container and lid having a unique configuration which serves to prevent the permanent deformation or "compression set" of the sealing material which forms the seal between the lid and the container. Thus, when the lid of a container assembly made in accordance with the present invention is pressed upon the container with an excessive or large force (for example, due to the stacking of the containers upon one another when full), and the force is subsequently released or removed, the sealing material returns to its original size and shape thus preserving the integrity of the seal between the lid and the container.

Generally, the invention provides a container assembly having a lid for closing and sealing the open end of a container. The container includes an outwardly curled sealing lip at its upper most periphery. The lid may include a circumferentially continuous rim having inner and outer legs, and a top web portion or bridge connecting the legs. The legs and bridge cooperatively define a downwardly opening channel proportioned to fit over the lip of the container. A cavity is preferably formed in the bridge to receive a sealing material or the cavity may be cooperatively defined between the legs and bridge.

The lid further includes contact surface means in the proximity of the sealing material selectively to engage stop means on the sealing lip of the container to limit movement of the lid relative to the container under an excessive pressure load. The contact surface means may comprise any one of a variety of configurations as discussed in the proceeding detailed description of the invention. In one preferred embodiment, the contact surface means comprise rim shoulders on the bridge located on each side of the cavity and lip shoulders located on each side of a sealing projection formed on the top surface of the lip which engages the sealing material.

The contact surface means engaging the opposing container lip serves to limit the minimum size of the cavity when the lid is pressed onto the container. By limiting the minimum size of the cavity, upon excessive pressure being applied to the lid, the permanent deformation of the sealing material, or the formation of "compression set", is avoided. Thus, the contact surface means on the lid rim and the stops on the container sealing lip help to maintain the integrity of the seal formed between the lid and the container. Therefore, in the aforementioned preferred embodiment, the opposing end shoulders of the bridge and lip are designed to contact one another upon application of an excessive force to the lid before the sealing projection of the lip extends too far into the sealing material, which would otherwise lead to the permanent deformation of the sealing material.

Locating the contact surface means in the immediate proximity of the sealing material is particularly advantageous for it helps to ensure that the sealing material is not permanently deformed even when the lid is made of a soft flexible material, such as a soft plastic. More particularly, placing the shoulders of the contact surface means in the immediate proximity of the sealing material helps to ensure that excessive loads exerted on the lid are transferred through the surface means to the stops on the lip of the container, and not through the sealing material. If the lid was constructed of a soft material and the surface means were not in the immediate proximity of the sealing material, loads could be transferred through the sealing materials.

The radially outer leg of the lid includes a protruding hook. The protruding hook engages the bottom edge of the sealing lip of the container when the lid is placed on the container thereby to lock the lid upon the container. The sealing material provides a biasing force which maintains the hook and rim in secure engagement thus preserving the seal between the lid and the container.

The foregoing and other features of the invention are hereinafter fully described and particularly pointed out in the claims, the following detailed description and annexed drawings setting forth in detail certain illustrative embodiments of the invention, these being indicative, however, of but a few of the various ways in which the principles of the invention may be employed.

DETAILED DESCRIPTION OF PREFERRED EMBODIMENTS

Figure 1:
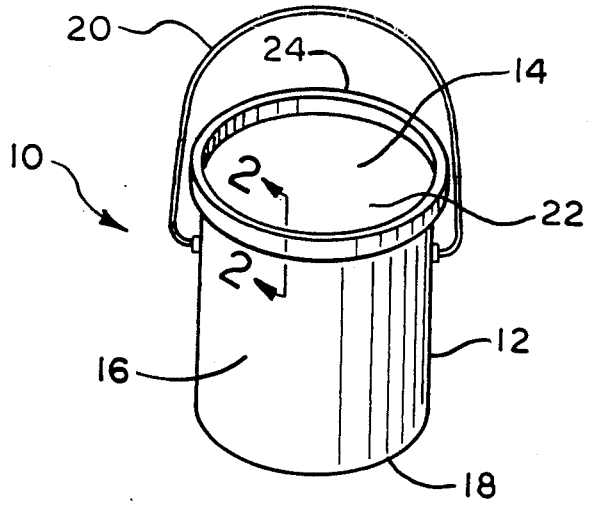
FIG. 1 is a perspective view of a container assembly made in accordance with the present invention with the lid assembled on the container to close its open end.
Figure 2:
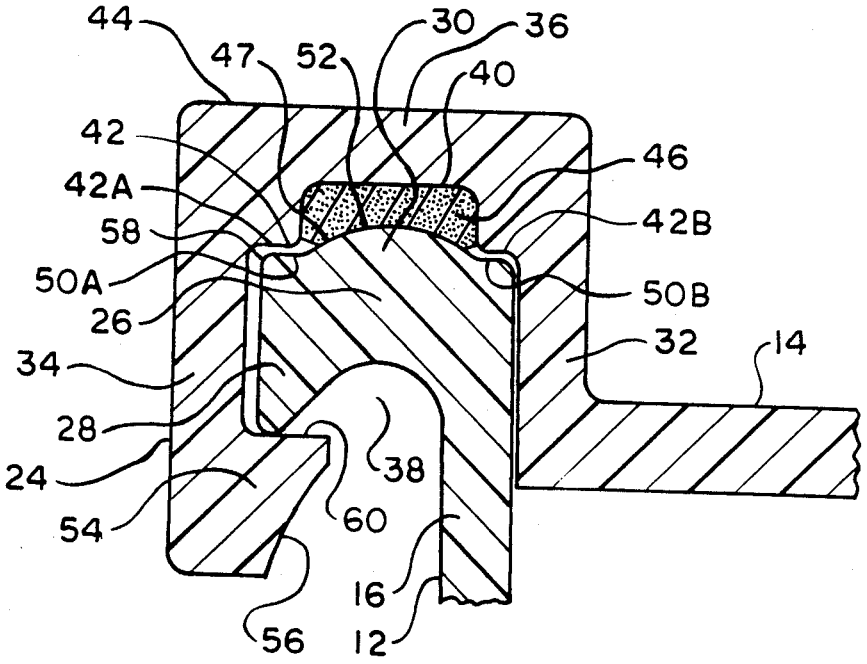
FIG. 2 is a broken away enlarged vertical cross-section of the assembled lid rim and container lip of the container assembly taken along the plane 2—2 of FIG. 1.

Referring now to the drawings and initially to FIGS. 1 and 2, the container or pail assembly of the present invention, indicated generally at 10, comprises a container 12 and a lid 14. The container 12 comprises a generally cylindrical sidewall 16 and a circular base 18 which forms the closed bottom of the container 12. Connected to sidewall 16 may be a pivotal handle 20 which facilitates the lifting and handling of the container assembly 10 but can selectively be pivoted out of the way to facilitate container stacking for storage purposes. The top of the sidewall 16 forms an opening to the container cavity or volume, which opening is selectively closed or covered by the lid 14.

The lid 14 comprises a circular flat portion or cover 22. Bounding the circumference of the circular cover 22 is a rim 24. The rim 24 is designed to securely engage the top of the sidewall 16 and form an airtight seal therewith ensuring the retention of the contents in the cavity of the container 12 and minimizing the ingress of external contaminants.

A radially outwardly curled sealing lip 26 is formed at the top of the sidewall 16 at its upper most periphery. The lip 26 along its inner diameter is contiguous with the sidewall 16. Along its outer diameter the lip 26 forms a protruding leg 28. The upper surface of lip 26 has an upwardly protruding sealing projection 30 thereon, with the sealing projection preferably having a smoothly rounded contour as shown in FIG. 2.

The rim 24 of lid 14 includes a radially inner vertical leg 32 and a radially outer vertical leg 34, both of which extend substantially parallel to the sidewall 16. Interconnecting the inner leg 32 and the outer leg 34 and extending substantially perpendicular to the sidewall 16 is the bridge or top web portion 36. The bridge 36, inner leg 32 and outer leg 34 cooperatively form a downwardly extending circumferentially continuous channel 38 into which the lip 26 is received. A downwardly opening seal cavity 40 is formed in the bridge 36 and extends from the bottom surface 42 of the bridge 36 upwardly toward the top wall 44 of the rim 24. The cavity 40 has substantially the same width as the bulge sealing projection 30 on the container lip 26.

Disposed within the seal cavity 40 is sealing material 46. Sealing material 46 may comprise any one of a variety of materials. However, preferably sealing material 46 comprises a rubber based material which is thoroughly mixed with an inert gas such as carbon dioxide or nitrogen so as to form a material which is about 50 percent voids. Such a material may be produced, for example, by using a gas injection process sold under the trademark FOAMMELT® by the Nordson Corporation of Norcross, Ga. The sealing material 46 is preferably gunned into the seal cavity 40 and is then allowed to set up before the lid 14 is assembled onto the container 12.

Upon assembling the lid 14 upon the container 12, sealing projection 30 on the container lip extends into the sealing material 46 carried by the lid 14 slightly to compress the seal material 46 to provide a seal therebetween. This seal serves to prevent the contents of the container 12 from escaping therefrom and in turn prevents the surrounding atmosphere from entering and contaminating the contents therein.

The unique configuration of the top surface 47 of the lip 26 and the bottom wall surface of the bridge 36 prevents over compression of the sealing material 46. Over compression is commonly the result of stacking full container assemblies upon one another. Over compression, or deformation beyond the yield point of the sealing material, leads to a permanent deformation of the sealing material. Such permanent deformation of the sealing material is commonly known as "compression set". Once the sealing material 46 becomes permanently deformed, and the load creating the over compression is removed or released, the integral seal between the lid 24 and container 12 is essentially destroyed since the sealing material 46 does not return to its desired initial shape.

Over compression of the sealing material 46 is avoided in the invention by limiting the height of the sealing projection 30 and by providing structural means to limit the travel of the lid relative to the container under excessive loading pressures. For this purpose, the bottom wall 42 of the bridge 36 forms radially spaced and circumferentially continuous rim shoulders 42A and 42B immediately adjacent sealing cavity 40 to define contact surfaces. Rim shoulders 42A and 42B are superimposed above and aligned with opposed lip shoulders 50A and 50B, respectively. Lip shoulders 50A and 50B are radially spaced from one another and are positioned immediately adjacent sealing projection 30 to act as stop surfaces to preclude further lid 14 travel.

When excessive pressure is applied to the lid 14, rim shoulders 42A and 42B respectively contact lip shoulders 50A and 50B to stop further lid movement before the sealing projection 30 extends too far into the sealing material 46 leading to permanent deformation of the sealing material 46. Thus, the sealing projection 30 must have a height which is sufficient to allow the upper surface 52 of the sealing projection to contact and slightly compress the sealing material 46 over a significant portion of its surface area so as to provide a seal upon placement of the lid 14 upon the container 12, yet be short enough to allow the lip shoulders 52A and 52B and rim shoulders 50A and 50B to contact one another as a lid stop before the sealing material 46 is compressed beyond its yield point upon application of an excessive force.

Provided along the bottom of the outer leg 34 of rim 24 is a protruding U-shape hook 54 which engages the protruding end of leg 28 of the container lip 26 and retains the lid 14 upon container 12. Along the terminal edge of the hook 54 is an arcuate camming surface 56 which facilitates the placement of the lid 14 upon the container 12. Specifically, as the lid 14 is being pushed on, the arcuate camming surface 56 of the hook 14 of the rim slidingly contacts the upper, radially outer corner 58 of the lip 26. As a result of the sliding contact, the outer leg 34 deflects radially outwardly momentarily to expand the rim channel until the lid 14 reaches the position shown in FIG. 2 wherein the end of the protruding leg 28 on lip 26 engages the top surface 60 of the hook 54. Thus, because it is necessary for the outer leg 34 of rim 24 to deflect during assembly, preferably the lid 14 is made of a flexible material, such as plastic. Container 12 may comprise any one of a variety of materials, however, preferably it also is made of plastic.

The sealing material 46 maintains the lid in the hooked position shown in FIG. 2, for it provides a biasing force which urges the lid 14 upwardly away from the container 12 to maintain hook 54 in engagement with lip 26. This biasing force is likely to be minimal or non-existent if the sealing material 42 is over compressed or permanently deformed. Without a sufficient biasing force, an adequate seal cannot be maintained since the lid may be loose on the container and the seal material may not have the required sealing compression. Thus, the formation and preservation of this biasing force is another reason for ensuring that the sealing material 46 not become over compressed.

Figure 3:
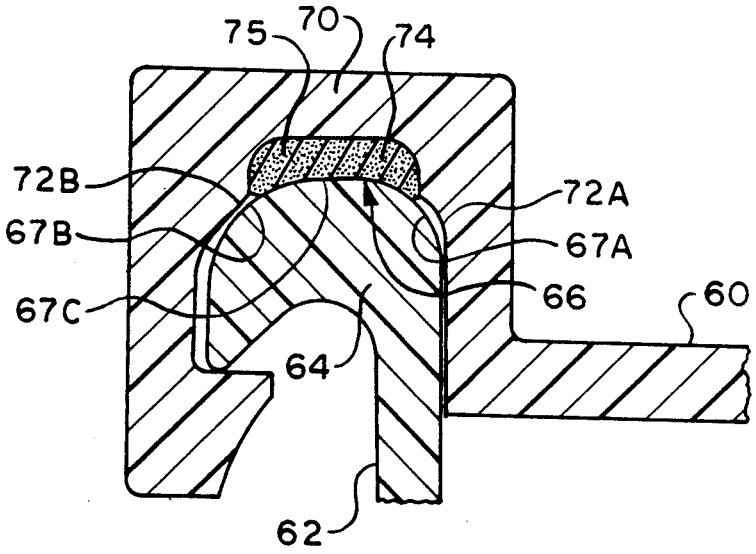
FIG. 3 is a broken away enlarged vertical cross-section of another embodiment of a lid rim and container lip assembly made in accordance with the present invention.

Referring now the FIG. 3, another configuration for a lid 60 and container 62 made in accordance with the present invention is illustrated. Specifically, the radially outwardly extending container lip 64 includes a top surface, indicated generally at 66 which has radially inner and out curved edges 67A and 67B. The curved edges extend over substantially the entire width of the top surface 66 of lip 64 providing the surface with only a small flat portion 67C located between the edges 67A and 67B. Similarly, the bottom surface of the bridge 70 includes a radially inner and outer curved portions 72A and 72B, respectively on each side of the seal cavity 74. Curved portion 72B, located on the outboard side of the cavity 74, has a different taper than the curved portion 72A located on the inboard side of the cavity 74. More particularly, curved portion 72B includes a portion which is essentially flat and extends at an angle of about 45 degrees.

Upon application of a pressing force upon lid 60, the curved portions at 67A and 67B of the top surface 66 of lip 64 contact the curved portions 72A and 72B on each side of the cavity 74 before the sealing material 75 is overcompressed. Therefore, the curved portions 72A and 72B of the rim act as contacting surfaces to engage surfaces 67A and 67B of the lip to stop further movement of the lid toward the container 62. By thus limiting lid travel, the minimum volume of seal cavity 74 is defined since the sealing projection or flat portion 67C on the lip 64 cannot be moved any further into the seal cavity 74. This minimum volume of the seal cavity 74 is sufficiently large to ensure that the sealant material 75 contained therein will not be over compressed.

Figure 4:
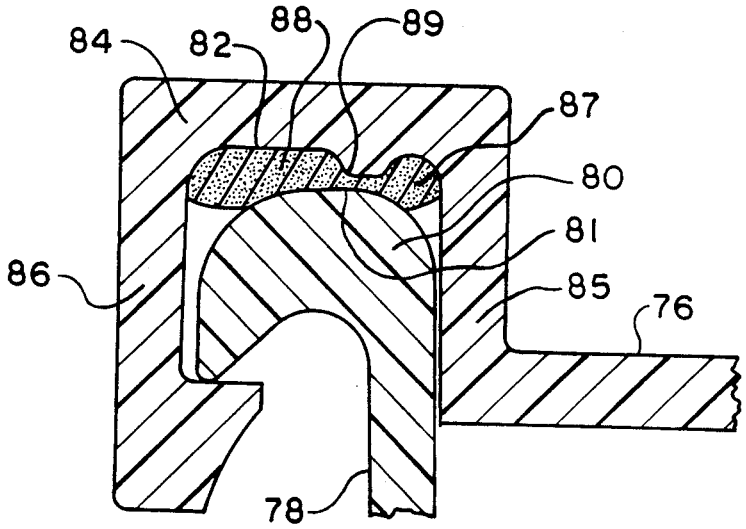
FIG. 4 is a broken away enlarged vertical cross-section of another embodiment of a lid rim and container lip assembly made in accordance with the present invention.

Referring now to FIG. 4, another embodiment of a lid 76 and container 78 configuration made in accordance with the present invention is illustrated. Specifically, the lip 80 of the container 78 includes a curved top surface 81 like that shown in the embodiment of FIG. 3. However, the bottom surface 82 of the bridge 84 and the inner and outer legs 85 and 86 of the rim cooperatively define a sealant cavity 87 for receiving sealing material 88 which extends along the entire width of the bridge 84. Included along the length of the bottom surface 82 of bridge 84 is a protruding tab or contacting surface 89. Preferably, tab 89 annularly extends around the entire circumference of lid 76. However, it will be appreciated that the present invention contemplates a configuration wherein a plurality of tabs 89 extend only at discrete intervals along the circumference of the lid 76. As shown, tab 89 is preferably not located in the center of the cavity 86. Thus, the amount of sealing material 88 on the radially inner side of tab 89 is less than that on the radially outer side.

Circumferentially continuous tab 89 serves to prevent the over compression of the seal material 88 located on the inboard outboard sides of the tab 89. Specifically, when lid 76 is pressed onto the container 78 with excessive force, the tab 89 fully compresses the sealing material 88 located between it and the top surface 81 of the lip 80 effectively to inhibit any further motion of the lid 76 relative to the container 78. By thus stopping lid travel, the sealing material 88 radially inside and outside the tab 89 is not over compressed thereby to retain seal integrity.

Figure 4A:
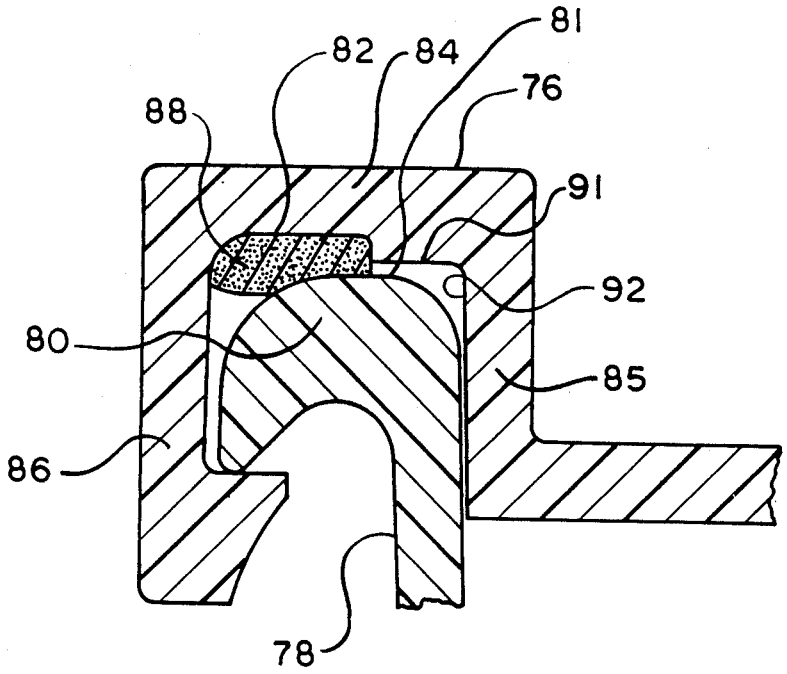
FIG. 4A is a broken away enlarged vertical cross-section of the embodiment of FIG. 4 including a minor variation thereof.

Referring now to FIG. 4A, there is illustrated the lid 76 and container 78 with a minor variation. Specifically, the bottom surface 82 of the bridge 84 forms a tab 91 which extends all the way to the outer wall 92 of the inner leg 85. Also, preferably as shown, the sealing material 88 does not extend beyond the tab 91. Thus, this particular modified embodiment uses less sealing material 88 than the embodiment illustrated in FIG. 4. When the lid 76 is pressed onto the container 78 with excessive force, the tab 91 contacts the top surface 81 of the lip 80 preventing the over compression of the sealing material 88.

Figure 5:
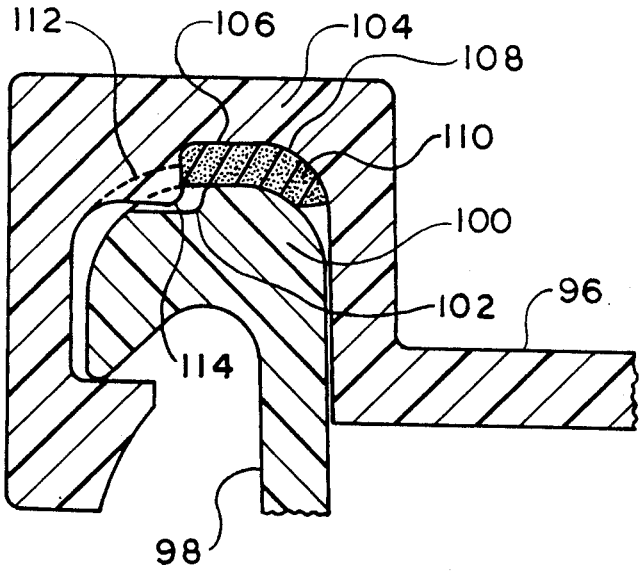
FIG. 5 is a broken away enlarged cross-section of yet another embodiment of a lid rim and container lip of a container assembly made in accordance with the present invention and taken along the plane 5—5 of FIG. 6.
Figure 6:
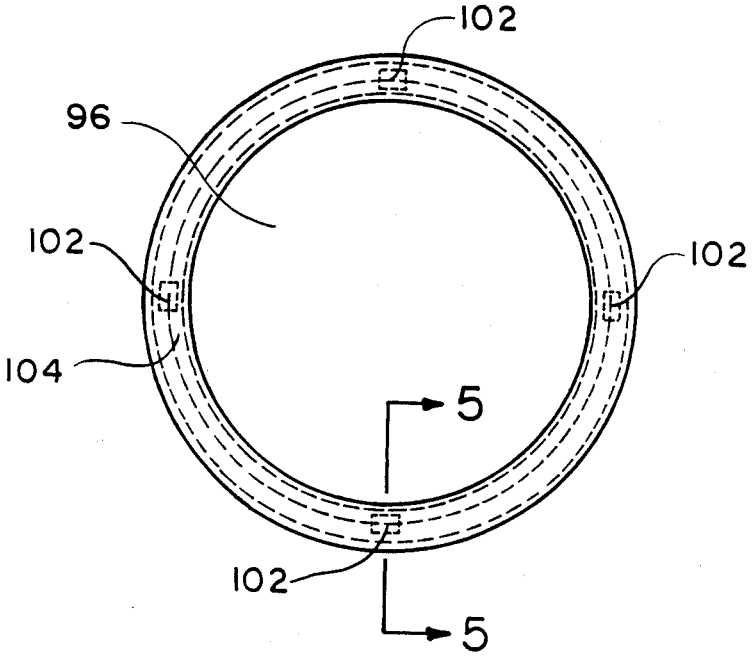
FIG. 6 is schematic top plan of the container assembly partially illustrated in FIG. 5.

Referring now to FIGS. 5 and 6, still another configuration for a lid 96 and container 98 made in accordance with the present invention is shown. Specifically, container 98 includes an upper radially outwardly curved lip 100 having multiple steps 102 formed in the top surface thereof. The steps 102 may be circumferentially spaced along the circumference of the lip 100 as shown in FIG. 6. The lid 96 includes a bridge web 104 having a bottom surface 106 which forms a cavity 108 for receiving sealant material 110. The bottom surface 106 includes a tapered portion 112 located to the outboard side of the sealant material 110 which extends along these portions of the rim 100 which are not in alignment with steps 102.

Projecting tabs or contact surfaces 114 protrude from the inner, bottom surface 108 of bridge 104 at circumferentially spaced intervals corresponding to the spacing of steps 102 formed in the lip 100. As shown in FIG. 6, steps 102 and projecting tabs 114 may be provided at 90 degree circumferentially intervals around the circumference of the container 98 and lid 96. However, it will be appreciated that the present invention contemplates any number of steps 102 and projecting tabs 114 spaced at various intervals along the circumference of the container 98 and lid 96. Also, it will be appreciated that the invention contemplates a container and lid having steps 102 and tabs 114 which extend along the entire circumference of the lid and container.

When the lid 96 is pushed onto the container 98 with excessive force, the projecting tabs 114 are received in and engage the steps 102 of the rim 100 to stop further travel of lid 96 toward container 98, thereby to prevent over compression of the sealant material 110.

Although the invention has been shown and described with respect to preferred embodiments, it is obvious that equivalent alterations and modifications will occur to others skilled in the art upon reading and understanding this specification. The present invention includes all such equivalent alterations and modifications, and is limited only by the scope of the following claims.

What is claimed:

1. A container assembly comprising a container and a lid for sealing an open end of said container, said container having a radially outwardly extending curled sealing lip at its upper most periphery, said lid having a peripheral rim including radially inner and outer legs and a bridge extending between and connecting said legs, said legs and said bridge of said rim cooperatively defining a downwardly opening channel receiving said container lip when said lid is assembled on said container, a seal cavity formed by at least said bridge, said cavity including a sealing material received therein which is slightly compressed by said lip when said lid is assembled on said container to form a seal therebetween, said lid having contact surface means for engaging opposed stop surface means on said container lip for limiting further travel of said lid relative to said container thereby to limit the minimum size of said cavity when said lid is pressed onto said container with excessive force to avoid over compression of said sealing material by limiting the minimum size of said cavity; said outer leg of said lid including a substantially horizontally and radially inwardly extending hook to engage the bottom outside periphery of said container lip so as to secure said lid on said container; said sealing material being positioned to bias said lid upwardly such that said sealing material biases said substantially horizontally extending hook into contact with said lip; said contact surface means being of sufficient height that the yield point of said sealing material is not reached and there is no permanent deformation of said sealing material when said lid is pressed onto said container and said contact surface means engage said stop surface means on said lip; said container lip having a top surface which throughout its length is substantially arcuate and said bridge includes a bottom surface which forms said cavity, said surface contact means comprising a protruding tab located inboard of said cavity and contiguous with said inner leg of said peripheral rim, said protruding tab having a bottom surface that extends outwardly from said inner leg of said peripheral rim, said sealing material located outboard of said protruding tab between said protruding tab and said outer leg of said peripheral rim, said sealing material also extending within said cavity towards said lip of said container and below the bottom surface of said protruding tab when said lid is pressed onto said container and said hook of said outer leg of said lid is in engagement with the bottom outside periphery of said container lip, said bottom surface of said protruding tab contacting said top surface of said container lip when said lid is pressed onto said container with excessive force thereby limiting the minimum size of said cavity.

2. A container assembly comprising a container and a lid for sealing an open end of said container, said container having a radially outwardly extending curled sealing lip at its upper most periphery, said lid having a peripheral rim including radially inner and outer legs and a bridge extending between and connecting said legs, said legs and said bridge of said rim cooperatively defining a downwardly opening channel receiving said container lip when said lid is assembled on said container, a seal cavity formed by at least said bridge, said cavity including a sealing material received therein which is slightly compressed by said lip when said lid is assembled on said container to form a seal therebetween, said lid having contact surface means for engaging opposed stop surface means on said container lip for limiting further travel of said lid relative to said container thereby to limit the minimum size of said cavity when said lid is pressed onto said container with excessive force to avoid over compression of said sealing material by limiting the minimum size of said cavity; said outer leg of said lid including a substantially horizontally and radially inwardly extending hook to engage the bottom outside periphery of said container lip so as to secure said lid on said container; said sealing material being positioned to bias said lid upwardly such that said sealing material biases said substantially horizontally extending hook into contact with said lip; said contact surface means being of sufficient height that the yield point of said sealing material is not reached and there is no permanent deformation of said sealing material when said lid is pressed onto said container and said contact surface means engage said stop surface means on said lip; said container lip having a top surface which throughout its length is substantially arcuate and said bridge including a bottom surface which forms said cavity, said surface contact means comprising a protruding tab located inboard of said cavity, said protruding tab having a bottom surface and extending outwardly from said inner leg of said peripheral rim, said sealing material extending within said cavity towards said top surface of said lip of said container below the bottom surface of said protruding tab when said lid is pressed onto said container and said hook of said outer leg of said lid is in engagement with the bottom outside periphery of said container lip, said bottom surface of said protruding tab directly contacting said top surface of said container lip when said lid is pressed onto said container with excessive force thereby limiting the minimum size of said cavity.

* * * * *